United States Patent [19]

Houser et al.

[11] 4,089,452

[45] May 16, 1978

[54] ORIENTATION APPARATUS FOR MULTIPLE TWISTED WIRES

[75] Inventors: David Erle Houser, Apalachin; Richard Jay Morenus, Endwell, both of N.Y.

[73] Assignee: International Business Machines Corporation, Armonk, N.Y.

[21] Appl. No.: 797,276

[22] Filed: May 16, 1977

[51] Int. Cl.[2] ..... B65H 17/22

[52] U.S. Cl. ..... 226/157; 226/77; 226/182; 226/193; 228/4.5

[58] Field of Search ..... 226/77, 76, 157, 182, 226/190, 193; 228/4.5

[56] References Cited

U.S. PATENT DOCUMENTS

| | | | |
|---|---|---|---|
| 189,914 | 4/1977 | Blakeslee | 226/77 |
| 1,862,331 | 6/1932 | Coffing | 226/77 X |

*Primary Examiner*—Richard A. Schacher
*Attorney, Agent, or Firm*—Norman R. Bardales

[57] ABSTRACT

Pre-twisted multiple wires having N twisted sections per full-twist pitch, where N is a predetermined constant integer, are juxtaposed to a roller which carries plural conformal seat means in a circumferential manner. The arcuate spacing between adjacent seat means is correlated with 1/Nth of the full-twist pitch of the particular twisted wires. Associated with the roller is ratchet means which allows the roller to be indexable in increments correlated with a full-twist pitch of the particular multiple twisted wires. As a result, the twisted wires are fed out in full-twist linear increments and, hence, with the same orientation of the wires for each incrementing step. Moreover, by judiciously seating one of the N possible adjacent twist sections of the twisted wires with respect to the seat means, the twisted wires can be fed out selectively with N possible orientations. The preferred embodiments described herein orient a pair of twisted wires which have two twisted sections per full-twist pitch, that is to say, two half-twist sections per full-twist.

10 Claims, 5 Drawing Figures

ORIENTATION APPARATUS FOR MULTIPLE TWISTED WIRES

BACKGROUND OF THE INVENTION

1. Field of the Invention

This invention is related to apparatus associated with the working of twisted wires and more particularly to apparatus for orienting twisted wires.

2. Description of the Prior Art

Apparatus for working twisted wires are well-known in the art. Thus, for example, in the publication entitled "Twisted Pair Wiring Machine", C. N. Bowman, IBM Technical Disclosure Bulletin, Volume 13, No. 2, July 1970, pages 368–369; or in U.S. Pat. No. 3,646,307, entitled "Wiring Apparatus", filed Sept. 24, 1970, and issued Feb. 29, 1972, or in U.S. Pat. No. 3,960,309, entitled "Fine Wire Twisted Pair Routing and Connecting System", both of which patents have a common inventorship and a common assignee, to wit: Herbert K. Hazel and International Business Machines Corporation, respectively, common assignee herein; or in U.S. Pat. No. 3,989,178, entitled "Wire Maze Penetrating Apparatus", filed Dec. 11, 1975, and issued Nov. 2, 1976, David E. Houser co-inventor herein, Kenneth J. Lubert, and Richard J. Morenus, co-inventor herein, and also assigned to the common assignee herein; there are disclosed apparatus where twisted wire pairs are bonded to circuit boards and the like.

In automated systems of effecting such multiple bondings such as, for example, the ones described in the aforementioned patents, it is important that the twisted wires have a particular orientation before effecting the bonding. This is particularly the case, for example, if the wires are associated with different circuit lines. For example, in a twisted wire pair generally one wire is associated with one type of circuit line, e.g. the signal line, and the other is associated with another type of circuit line, e.g. the ground line. These prior art systems, however, lacked means for orienting the twisted wires in a reliable and simple manner and often required visual inspection and/or manual intervention to insure proper orientation.

More specifically, it should be understood that in the prior art system described in the aforementioned U.S. Pat. No. 3,960,309, which is incorporated herein by reference, that when the twisted wire pair thereof is positioned at the bonding site, a determination is made of the orientation of the signal wire and ground wire of the twisted wire pair with respect to the signal and ground reflow solder pads on the workpiece to which they are to be bonded. If the determination indicates that the orientation is correct, then the bond is effected. For sake of explanation, the correct position is sometimes referred to herein as the obverse orientation. If on the other hand the determination indicates that the orientation is incorrect, the twisted wire pair feeding tool, which feeds the twisted wire pair through an axial bore of the tool, is rotated about the axial bore one hundred eighty degrees to provide the correct orientation, hereinafter sometimes referred to as the reverse orientation, prior to effecting the bonding. In this last regard, the feeding tool in effect flips, i.e. turns, the twisted wire pair upside down to provide the correct orientation in the bonding plane. It should be understood that the feeding tool is also mounted in a rotatable turret head which allows the feeding tool and, hence, the wires to be also angularly positionable about an axis substantially normal to the bonding plane.

While this last described prior art system was in general satisfactory, it has several disadvantages. For example, the aforementioned orientation determination required a visual, i.e. operator, inspection. Alternatively, it has been suggested that a combined closed TV and electronic detection circuitry, which is based on color discrimination between the two different colored insulating coverings used on the respective signal and ground wires, be utilized to make the orientation determination, cf. the publication entitled "Color Detection Sytem", R.H. Hojaboom et al, IBM Technical Disclosure Bulletin, vol. 19, Nov. 12, 1977, pages 4552–4553. In both these cases, however, the determintion was not amenable for integration into or compatible with a fully automated wire routing and bonding system and particularly if the routing and bonding system was under computer control, Moreover, these types of determination were subject to human error and in the case of the closed TV system were expensive and complex to implement. Furthermore, in this particular prior art system, the twisted wire pair after exiting from the aforementioned axial bore was adapted to be gripped by actuatable clamping jaws of the feeding tool. However, the clamping jaws and/or their actuation was not synthesized with the feeding of the twisted wire pair and/or the twisted wire pair feed was subject to slipping. Hence, there was no consistency or reliability in the prior art system, that the clamping jaws, each time they were actuated, would grip the same corresponding half-twist section for each consecutive full-twist section. As a result, in the prior art system, the twisted wire pair was in a randomly oriented one of two possible positions between the actuated clamping jaws. This randomness and concomitant unreliability was, hence, incompatible with a fully automated system.

SUMMARY OF THE INVENTION

It is an object of this invention to provide orientation of multiple twisted wires in an efficient, simple and reliable manner.

It is another object of this invention to provide the aforementioned orientation of multiple twisted wires which is particularly useful for automated and/or computer controlled twisted wire working systems, such as wire routing and bonding systems, for example.

Still another object of this invention is to provide the aforementioned orientation on a selective basis.

Still another object of this invention is to provide the aforementioned orientation for a pair of twisted wires sometimes referred to herein as a twisted wire pair.

According to one aspect of the invention, there is provided apparatus for orienting plural twisted wires having N twisted sections per the full-twist pitch associated with the particular twisted wires, where N is a constant integer greater than 1 that includes, inter alia, plural seat means that are disposed in a predetermined circumferential manner about roller means. Each of the seat means has a conformal configuration compatible to the configuration of a twisted section. The arcuate spacing between adjacent seat means is correlated with 1/Nth of the full-twist pitch. A ratchet means is associated with the roller means for the indexing of the roller means in rotational increments correlated to the full-twist pitch. As a result, the twisted wires are fed out from the roller means in full-twist linear increments whenever the twisted wires are seated in a predetermined operative feeding relationship with the seat means.

According to another aspect of the invention, the apparatus orients a twisted wire pair.

The foregoing and other objects, features and advantages of the invention will be apparent from the following more particular description of the preferred embodiments of the invention, as illustrated in the accompanying drawing.

BRIEF DESCRIPTION OF THE DRAWING

In the figures, like elements are designated with similar reference characters.

DESCRIPTION OF THE PREFERRED EMBODIMENTS

Figure 2:
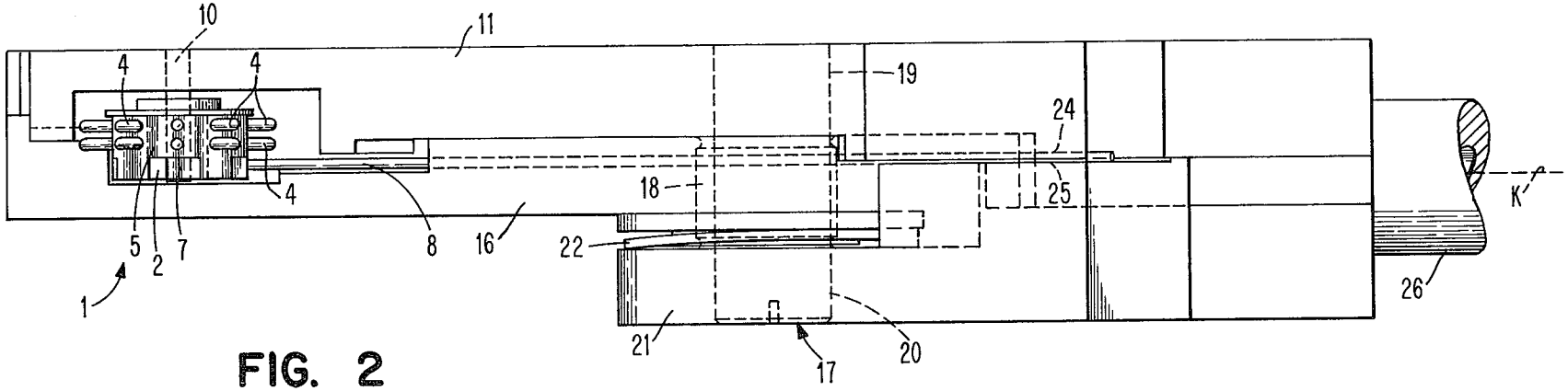
FIG. 2 is a top elevation view of the embodiment of FIG. 1.
Figure 1:
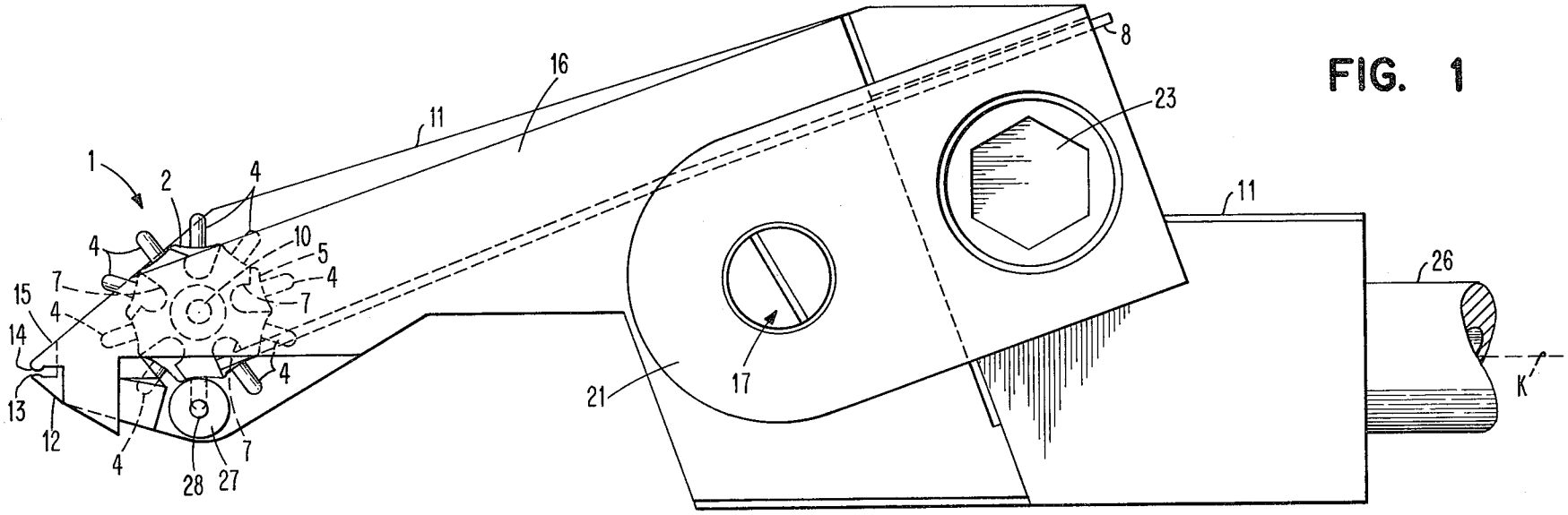
FIG. 1 is a front elevation of a preferred embodiment of the present invention.
Figure 3:
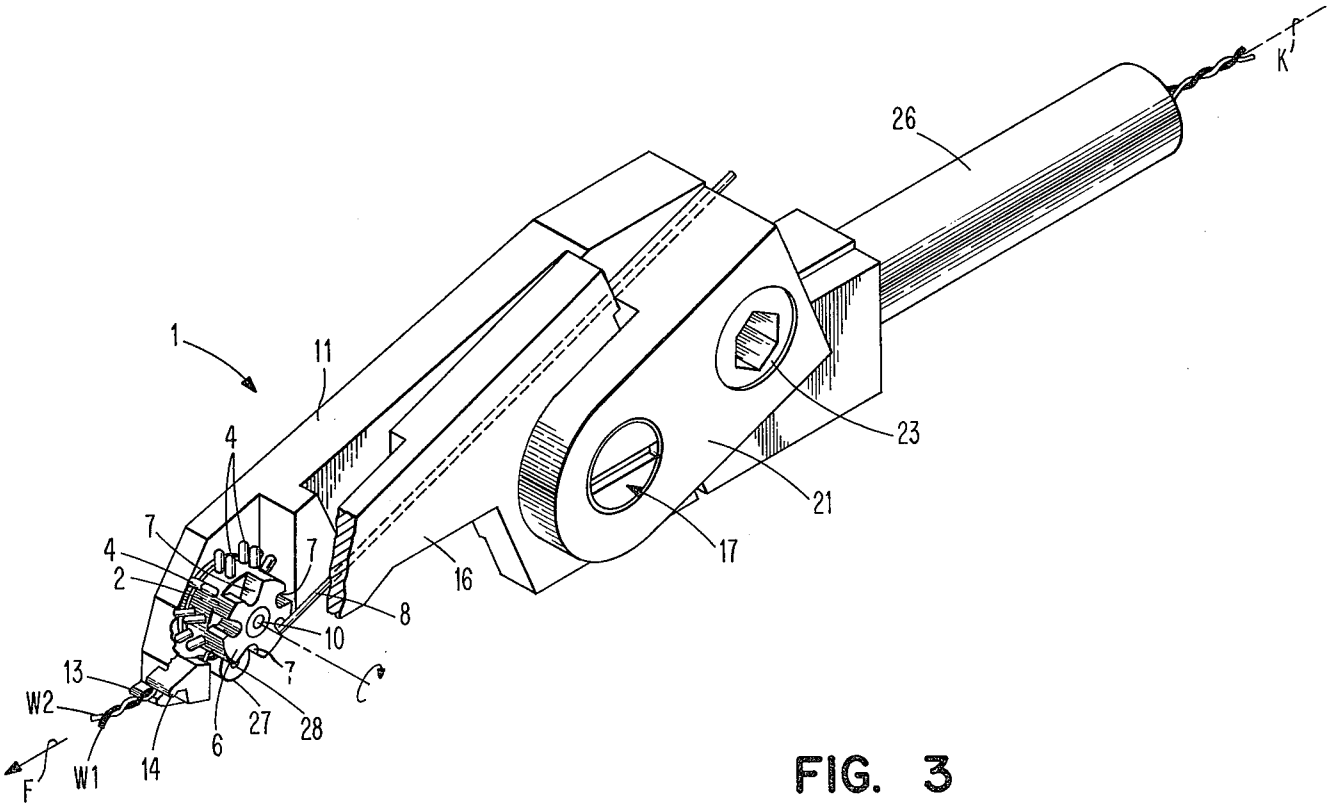
FIG. 3 is a perspective view of the embodiment of FIG. 1, partially broken away for sake of clarity.

In FIGS. 1–4, the apparatus for orienting plural twisted wires is generally indicated by the reference numeral 1.

By way of explanation, the plural twisted wires have a predetermined number N of twisted sections for each full-twist pitch of the twisted wires, where N is a predetermined constant integer greater than one. In the embodiments of FIGS. 1–4, and 5, N is two, each section being referred to herein sometimes as a half-twist section. Also as previously mentioned, in the embodiments of FIGS. 1–4 and 5, the number of plural twisted wires is two, cf. twisted pair of wires W1, W2, FIG. 4, or Wa, Wb, FIG. 5, that are to be oriented by the twisted wire orienting apparatus of the particular embodiment, e.g. apparatus 1 of the embodiment of FIGS. 1–4. Thus, as illustrated, for example, in FIG. 4, the twisted wire pair W1, W2 has two sections, A, B in each successive substantially equal full-twist pitch P1, P2, P3, etc., of the twisted wires W1, W2. In a similar manner, the twisted wire pair Wa, Wb, FIG. 5, has two sections *a, b,* in each successive full-twist pitch *p1, p2, p3,* etc.

Referring now to FIGS. 1–4, in apparatus 1 thereof there is provided roller means, cf. roller 2, which has plural seat means designated generally by the reference numeral 3. In the embodiment of FIGS. 1–4, the seat means 3 are two spaced parallel rows of aligned pinlike members 4 which project radially outward from the circumferential wall 5 of roller 2. The arcuate spacing between adjacent pins 4 of the same row and, hence, the arcuate spacing between adjacent seat means 3, is correlated with 1/Nth of a full-twist pitch of the twisted wires. Thus, in the embodiment of FIGS. 1–4, the arcuate spacing is ½ of a full-twist pitch, e.g. pitch P1 of wires W1, W2. For each pin 4 in one of the rows there is a corresponding aligned pin 4 in the other row. Thus, in the embodiment of FIGS. 1–4, the coaction of the pins 4 together with their respective arcuate spaces between pins 4 of the same row and the space between the two rows of pins 4 provide the plural seat means 3 with a conformal configuration which is compatible to the configuration or shape of the twisted section, i.e. section A or B, of the twisted wires W1, W2. Hence, as shown in greater detail in FIG. 4, each of the sections A, B of the wires W1, W2 is adapted to be located or seated between the two rows of pins 4, which two rows act as guides or a channel for the twisted wire pair W1, W2, and such that each pair of the aforementioned corresponding aligned pins 4 of the two rows are juxtaposed to the interconnecting nodes of adjacent sections A, B, A, B, A, etc., i.e. the crossover points D of wires W1, W2. As a result, between each adjacent pair of corresponding pins 4 of the two rows, one section A or B, depending on the case, is seated.

Associated with the roller 2 are ratchet means which includes a ratchet wheel portion 6 having teeth or pockets 7 and a ratchet pawl or pin 8 in coacting relationship with pockets 7. The ratchet wheel portion is preferably an integral member of the roller 2 but may be a separate member affixed thereto. The ratchet means allows the indexing of said roller 2 in rotational increments that are correlated to a full-twist pitch of the twisted wires being oriented by apparatus 1. In the embodiment of FIGS. 1–4, the bottom of pockets 7 are aligned, for example, with alternate pairs of the corresponding aligned pins 4 of the two rows, as shown by the imaginary dash lines 9 extended therebetween in FIG. 4. Consequently, when twisted wires W1, W2 are seated in the seat means 3, it will be fed out from roller 2 in full-twist linear increments, cf. arrow F for direction of feed.

Figure 4:
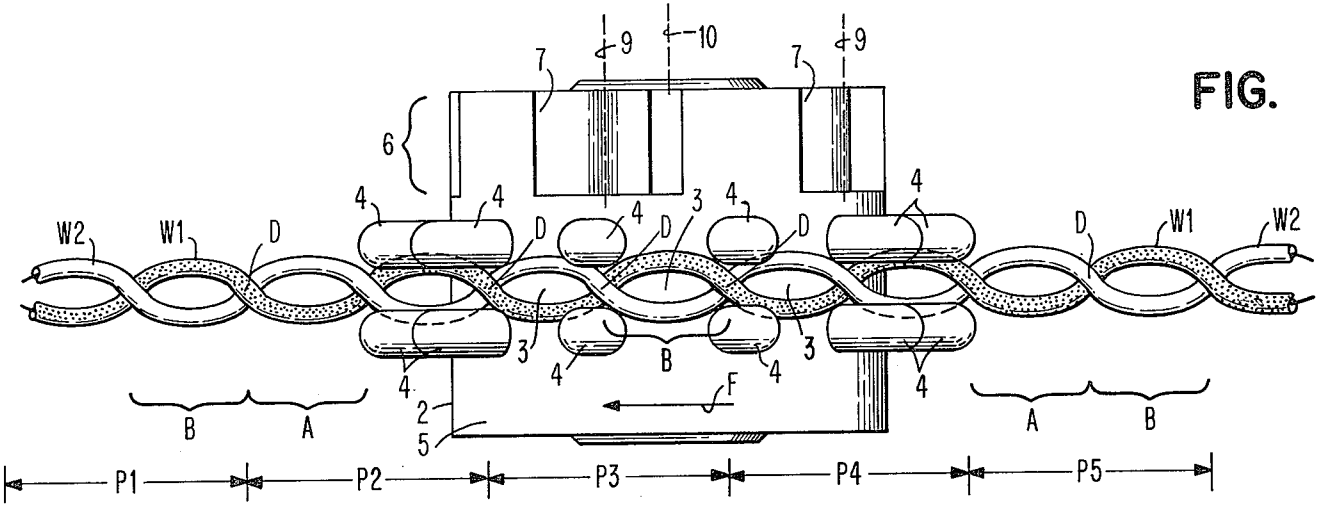
FIG. 4 is an enlarged bottom schematic view of the roller of the embodiment of FIG. 1.

It should be noted that each full-twist section of wires W1, W2 has two consecutive half-sections designated arbitrarily by the aforementioned reference characters A, B, for sake of convention and explanation. As viewed facing FIG. 4, for each section A, wire W1 passes over the top of wire W2 at the leading crossover point D of section A, whereas, wire W2 passes over the top of wire W1 at the leading crossover point D for each section B. Each time the roller 2 is incremented one step and the twisted wires W1, W2 are in operative feeding relationship with at least one seat means 3, the sections A, B for each corresponding full-twist linear increment of the wires W1, W2 fed out from roller 2 will have the same orientation. Moreover, by judiciously seating the sections A, B of wires W1, W2 with respect to pockets 7, the sequence of the sections A, B for each full-twist linear increment can be selected and, hence, the respective orientation of the wires W1, W2. Thus, as shown in FIG. 4, the leading crossover points D of the sections B are selected to be located between the corresponding pins 4 that are aligned with the bottoms 9 of pockets 7. As a result, in this case for each full-twist linear increment which is fed out, the sections B are the lead sections and the wires W1, W2 are in a first orientation. If the lead nodes D of the sections, A, on the other hand, are selected to be located adjacent these lastmentioned pins 4, then the A sections are the lead sections for each full-twist linear increment and the wires W1, W2 are in a second orientation.

Figure 5:
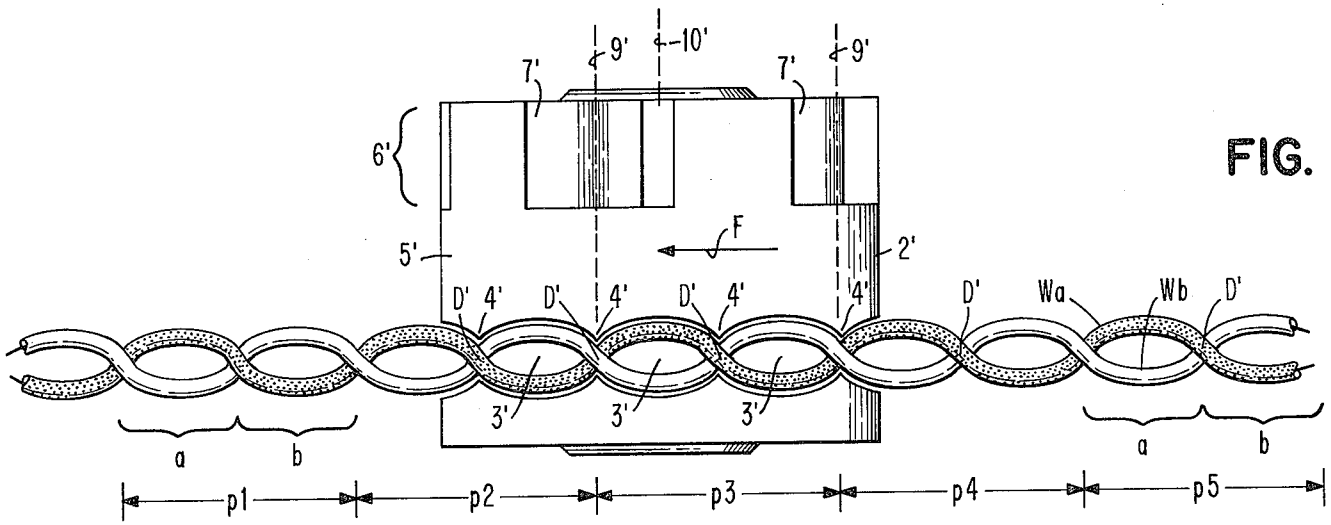
FIG. 5 is an enlarged bottom schematic view of the roller of another embodiment of the present invention.

For the embodiment of FIG. 5, only the roller 2′ is shown, for sake of clarity. The roller 2′ is similar to the roller 2 of FIGS. 1–4, except that each of the seat means 3′ thereof has a contoured ellipse-like recess formed downwardly in the circumferential wall 5′ of roller 2 which is conformal to the configuration of the half-twist sections *a, b* of twisted wires W*a,* W*b.* Between each adjacent pair of elliptical recesses of seat means 3′ are interconnected narrower interconnecting contoured recesses 4′ which are adapted to seat the node D′ of the two particular adjacent twisted wire pair half sections that are to be seated in the associated pair of adjacent elliptical recesses interconnected by the particular recess 4'. In all other aspects, the roller 2' is similar to that of roller 2, the roller 2' having ratchet pockets 7' aligned with alternate recesses 4', as shown by the extended lines 9'.

Referring again to FIGS. 1–4, roller 2 is rotatably mounted to a shaft 10 that is affixed in a cantilever manner to the elongated member 11 of apparatus 1. The end 12 of member 11 has a lower clamp tip or jaw 13 that is stationary with respect to the upper mating clamp tip 14 formed on the end 15 of movable member 16. More specifically, member 16 is pivotably mounted on a slotted-head eccentric pivot shaft 17 that adjusts the gap between tips 13 and 14. Shaft 17 has a center section 18 of slightly larger diameter than its outer sections 19, 20 so as to form respective annular shoulders therebetween. Member 16 is straddled by the member 11 and a clamp member 21, the three sections 18, 19, 20 of shaft 17 being slip fit into appropriate bores provided in members 16, 11 and 21, respectively. A spring washer 22 biases member 16 towards member 11, and bolt 23 which passes through member 21 is threadably engageable with the member 11. In practice, with bolt 23 in loose coupling engagement with member 21, eccentric shaft 17 is positioned angularly about its axis to a predetermined position commensurate with the gap desired between the normally open jaws 13, 14 when the jaws are in their closed positions. This gap is generally correlated with the twisted wire size. Bolt 23 is then turned securely in member 21 causing the aforementioned shoulders of shaft 17 to be tightly engaged against the respective inner surfaces of members 11 and 21 and thereby preventing the rotation of shaft 17, but leaving the member 16 to be pivotably rotatable on the center section 18 of the shaft.

The clamping action provided by bolt 23 clamps the upper end of cylindrical-shaped pawl 8 between members 11 and 21. More particularly as shown in FIG. 2, the upper end of pawl 8 is seated in an appropriate V-shaped notch or groove 24 formed in member 11 so that pawl 8 protrudes radially outward therefrom. As a result, the upper end of pawl 8 becomes clamped between groove 24 and the side 25 of member 21 by bolt 23. Pawl 8 is also clamped so that it extends longitudinally in cantilever fashion from clamping members 24, 25 and such that its lower end is in cooperative engaging relationship with the ratchet pockets 7 on roller 2. Member 11 has a hollow cylindrical extension or tube 26 through which the twisted wire pair W1, W2 are passed toward roller 2. If desired, another rotatable roller 27 is mounted on a shaft 28 which is affixed in a cantilever manner to member 11, roller 27 being adapted to maintain sections A, B, etc. in their respective seat means 3 as the twisted wires W1, W2 pass by the roller and are fed out between the wire clamp jaws 13, 14. Cylindrical tube 26 in turn is mounted in a suitable bearing, not shown for sake of clarity, so as to provide various orientation positions of the apparatus 1 about the center axis K of tube 26. Apparatus 1 and the lastmentioned bearing in turn are mounted in a rotatable turret head, not shown, so as to allow apparatus 1 to be pivotable about one or more mutually orthogonal axes. As such, the apparatus is readily adaptable to be utilized with automatic twisted wire handling systems such as the automatic wire routing and bonding system described in U.S. Pat. No. 3,960,309.

It should be understood that the invention can be practiced where the number N of sections of twisted wires per full-twist pitch is greater than two. In such cases the roller would be modified so that the rathet member, i.e. ratchet tooth or pocket, is correlated with every Nth seat means. For example, if the number N of twist sections per full-twist pitch was three, then a ratchet pocket would be provided for every third seat means, if $N=4$ then a ratchet pocket would be provided for every fourth seat means, etc. Moreover, the number of plural wires per section may be more than two. For example, there may be three wires per section, e.g. two signal wires and one ground wire, and/or the number of wires per section need not be the same as the number N of sections per full-twist pitch.

Furthermore, for the preferred embodiments, the rollers 2 or 2' are passively engaged with the twisted wires W1, W2 and the wires W1, W2 are adjusted to be fed past the roller by any suitable external means, not shown, for sake of clarity. Alternatively, the roller 2 may be driven, by means not shown for sake of clarity, so that the seat means 3 upon engaging the seated sections A, B causes or assists in the feeding of the twisted wires W1, W2 past the roller.

Thus, while the invention has been particularly shown and described with reference to preferred embodiments thereof, it will be understood by those skilled in the art that various changes in form and details may be made therein without departing from the spirit and scope of the invention.

We claim:

1. Apparatus for orienting plural twisted wires, said twisted wires having N twisted sections per full-twist pitch of said twisted wires, where N is a predetermined constant integer greater than one, the combination comprising:

roller means, plural seat means disposed in a predetermined circumferential manner about said roller means, each of said seat means having a conformal configuration compatible to the configuration of a said twisted section, the arcuate spacing between adjacent said seat means being correlated with 1/Nth of said full-twist pitch, and ratchet means associated with said roller means for indexing of said roller means in rotational increments correlated to said full-twist pitch whereby said wires are fed out from said roller means in full-twist linear increments whenever said twisted wires are seated in a predetermined operative feeding relationship with said seat means.

2. Apparatus according to claim 1 wherein said plural twisted wires have selectively orientable N possible orientations for each linear increment.

3. Apparatus according to claim 1 wherein said plural twisted wires are a pair of twisted wires.

4. Apparatus according to claim 1 where $N = 2$.

5. Apparatus for orienting plural twisted wires, said twisted wires having N twisted sections per full-twist pitch of said twisted wires, where N is a predetermined constant integer greater than one, the combination comprising:

a roller, plural seat means disposed in a predetermined circumferential manner about said roller, each of said seat means having a conformal configuration compatible to the configuration of a said twisted section, the arcuate spacing between adjacent said seat means being correlated with 1/Nth of said full-twist pitch, and a ratchet wheel associated with said roller for indexing of said roller in rotational increments correlated to said full-twist pitch whereby said wires are fed out from said roller in full-twist linear increments whenever said twisted wires are seated in a predetermined operative feeding relationship with said seat means.

6. Apparatus according to claim 5 wherein said plural twisted wires are a pair of twisted wires.

7. Apparatus according to claim 6 wherein $N = 2$.

8. Apparatus according to claim 6 further comprising clamping means for clamping said wires being fed out of said roller.

9. Apparatus according to claim 5 wherein each of said seat means comprises a pair of first and second radial pins extending outwardly from said roller.

10. Apparatus according to claim 5 wherein each of said seat means comprises a contoured recess for seating therein a said section of twisted wires.

* * * * *